United States Patent [19]

Irwin

[11] Patent Number: 4,589,328

[45] Date of Patent: May 20, 1986

[54] ROTARY PISTON ENGINE WITH RECIPROCATING CYLINDERS HAVING SEALING AND FRICTION REDUCING MEMBERS

[75] Inventor: Everett F. Irwin, Dunedin, Fla.

[73] Assignee: Dynacycle Corporation, Dunedin, Fla.

[21] Appl. No.: 697,061

[22] Filed: Jan. 31, 1985

[51] Int. Cl.[4] ..... F01B 13/06

[52] U.S. Cl. ..... 91/498; 91/493

[58] Field of Search ..... 91/474, 491–495, 91/498; 417/273; 92/58, 72

[56] References Cited

U.S. PATENT DOCUMENTS

| | | | |
|---|---|---|---|
| 1,358,504 | 11/1920 | Beijer | 91/493 X |
| 2,515,033 | 7/1950 | Connor | 91/498 X |
| 3,036,557 | 5/1962 | Kimsey | 91/490 X |
| 3,093,301 | 6/1963 | Mitchell | 91/493 X |
| 3,645,172 | 2/1972 | Koivunen | 91/493 X |
| 4,413,486 | 11/1983 | Irwin | 91/493 X |

FOREIGN PATENT DOCUMENTS

| | | | |
|---|---|---|---|
| 3040445 | 5/1982 | Fed. Rep. of Germany | 417/273 |
| 62198 | 4/1912 | Switzerland | 91/498 |

*Primary Examiner*—William L. Freeh
*Assistant Examiner*—Paul F. Neils
*Attorney, Agent, or Firm*—Ronald E. Smith; Harold D. Shall

[57] ABSTRACT

A rotary piston engine capable of operating as a fluid pump or motor having a stationary housing in which is concentrically mounted an outer rotatable member to which two pairs of diametrically opposed pistons are fixedly secured and project radially inwardly to each be received in a reciprocating cylinder. The opposed cylinders of each pair of cylinders reciprocate unitarily and the radially inner ends of such cylinders are slidingly and sealingly contacting the adjacent flat surface of a square cam drivingly connected to a rotatable shaft; the cylinders moving in a translatory manner on the flat cam during rotation of the shaft, with the shaft and cylinders rotating unitarily but eccentrically with respect to the outer rotatable member. Suitable ports are provided in the square cam to join the reciprocating cylinders to a source of pressure fluid. When operated as a motor, upon the supply of pressure fluid to the appropriate cylinder and exhausting of the appropriate cylinders in sequence, the device will cause the shaft to be driven.

2 Claims, 7 Drawing Figures

ROTARY PISTON ENGINE WITH RECIPROCATING CYLINDERS HAVING SEALING AND FRICTION REDUCING MEMBERS

BACKGROUND OF THE INVENTION

1. Field of the Invention

This invention relates generally to fluid displacement devices such as rotary engines and more particularly to improvements in rotary engines of the rotary piston with reciprocal cylinders type which can be utilized as a pump or motor. In the preferred embodiment its use as an air motor having high speed capabilities will be described.

2. Description of the Prior Art

U.S. Pat. No. 3,645,172 discloses a fluid pump or motor in the form of a wheel drive having an outer rotatable driven ring to which a plurality of inwardly extending pistons are secured. The pistons are received in cylinders, the inner ends of which cylinders are mounted on an inner ring and move translatory relative thereto. A pair of annular positioning rings mount all of the cylinders to the inner ring and in order for the cylinders to move relative to the inner ring, they must move relative to the positioning rings. This engagement between the positioning rings and the cylinders must be of a high degree of friction, and, since this is a wheel drive, it rotates at a relatively low speed. Further, since the inner ends of the cylinders move translatory on an inner ring, there is not only a reciprocal movement between the pistons and the cylinders but also the pistons oscillate within the cylinders. This oscillatory movement, while satisfactory for low speed wheel drives, it not felt to be satisfactory for high speed operation not only because of the difficulty of sealing the oscillatory movement, but also because of the higher inherent friction therein and also the high friction inherent in the previously described engagement of the positioning rings and the cylinders.

The present invention does away with the unitary positioning ring for all the cylinders and also does away with the oscillatory movement between the pistons and the cylinders so that a low friction engine is accomplished, which engine can be satisfactorily operated at high speeds if desired, while also being suitable for low speed operation.

The following is a list of U.S. patents in the general field of this invention in that they have radially disposed pistons, but, since they do not have reciprocating cylinders, are not deemed relevant to the present invention as claimed: U.S. Pat. Nos. 3,492,948; 3,577,830; 3,744,380; and 3,924,968.

SUMMARY OF THE INVENTION

A stationary motor housing having a cylindrical bore is mounted on a stationary shaft with the housing surrounding the inner end of the shaft and the axis of the shaft being mounted eccentrically relative to the axial center of the housing bore. Rotatably mounted on the inner end of the stationary shaft for rotation about the same axis as the stationary shaft relative to the shaft and the housing, is the rotatable output shaft which extends from the housing oppositely relative to the stationary shaft.

The inner end of the output shaft, which is disposed substantially axially centrally in the housing, is in the form of a square cam when viewed in transverse cross section and substantially square when viewed in axial cross section. Surrounding the inner end of the output shaft is an outer rotatable member which is mounted for rotation in the housing concentrically with the bore of the housing but eccentrically with respect to the axis of the output shaft. Two pairs of diametrically opposed pistons are fixedly secured to the rotatable member and project radially inwardly therefrom; with the first pair being disposed ninety degrees from the second pair, and the radially extending axis of each piston being perpendicular to one of the cam surfaces on the square cam of the output shaft.

The outer rotatable member and the output shaft rotate unitarily but eccentrically, so that a given piston, which is perpendicular to a particular cam surface, remains perpendicular to that cam surface, but because of the relative eccentric movement, the piston moves translatory relative to the associated cam of the square cam.

Telescopically receiving each of the pistons is a cylinder (there being two (2) oppositely disposed pairs of cylinders), which is open at both its radially outer and inner ends; the accompanying piston being received in the outer end of the cylinder while the inner end of the cylinder abuttingly and sealingly engages the adjoining flat cam surface of the square cam.

Each opposed pair of cylinders are secured together for unitary movement by suitable means, such as bridal rings, which control the spaced relationship of the cylinders and maintain the radially inner ends of the cylinders in engagement with the associated cam surface. Accordingly, as the square cam moves eccentrically relative to the pistons, the cylinders each reciprocate relative to the piston received by the cylinder, while the cylinder moves in a translatory manner relative to the associated cam flat. Suitable seals and friction reducing means are provided between the inner ends of the cylinders and the cam flats as hereinafter more fully described.

Inlet and outlet air passages are formed in the stationary shaft while two (2) pair of opposed passages are formed in the square cam confluent with the centers of the flat cam surfaces, and four (4) exhaust passages are formed in the axial end of the square cam. The cam passages upon rotation are alternately brought into confluent relationship with the inlet and exhaust passages in the stationary shaft. The cam air passages extend outwardly to the flat surfaces of the cam and sequentially charge and discharge the cylinders; the reactive or driving force on the cam carrying the output shaft being generated by the compression of the pressure fluid between the cam and the inner end of the piston, with the piston imposing no driving load, but functioning primarily as a reaction surface for the pressure fluid. The cylinders, as they rotate unitarily with the square cam, reciprocate relative to the pistons.

It is therefore an object of this invention to provide a rotary piston engine with reciprocating cylinders which incorporates low friction, is capable of high speed quiet operation, and capable of long life efficient operation.

The invention accordingly comprises the combination of elements, features of construction, and arrangement of parts that will be exemplified in the construction hereinafter set forth, and the scope of the invention will be indicated in the claims.

BRIEF DESCRIPTION OF THE DRAWINGS

For a fuller understanding of the nature and objects of the invention, reference should be made to the following detailed description, taken in connection with the accompanying drawings, in which.

DETAILED DESCRIPTION OF THE PREFERRED EMBODIMENT

Figure 1:
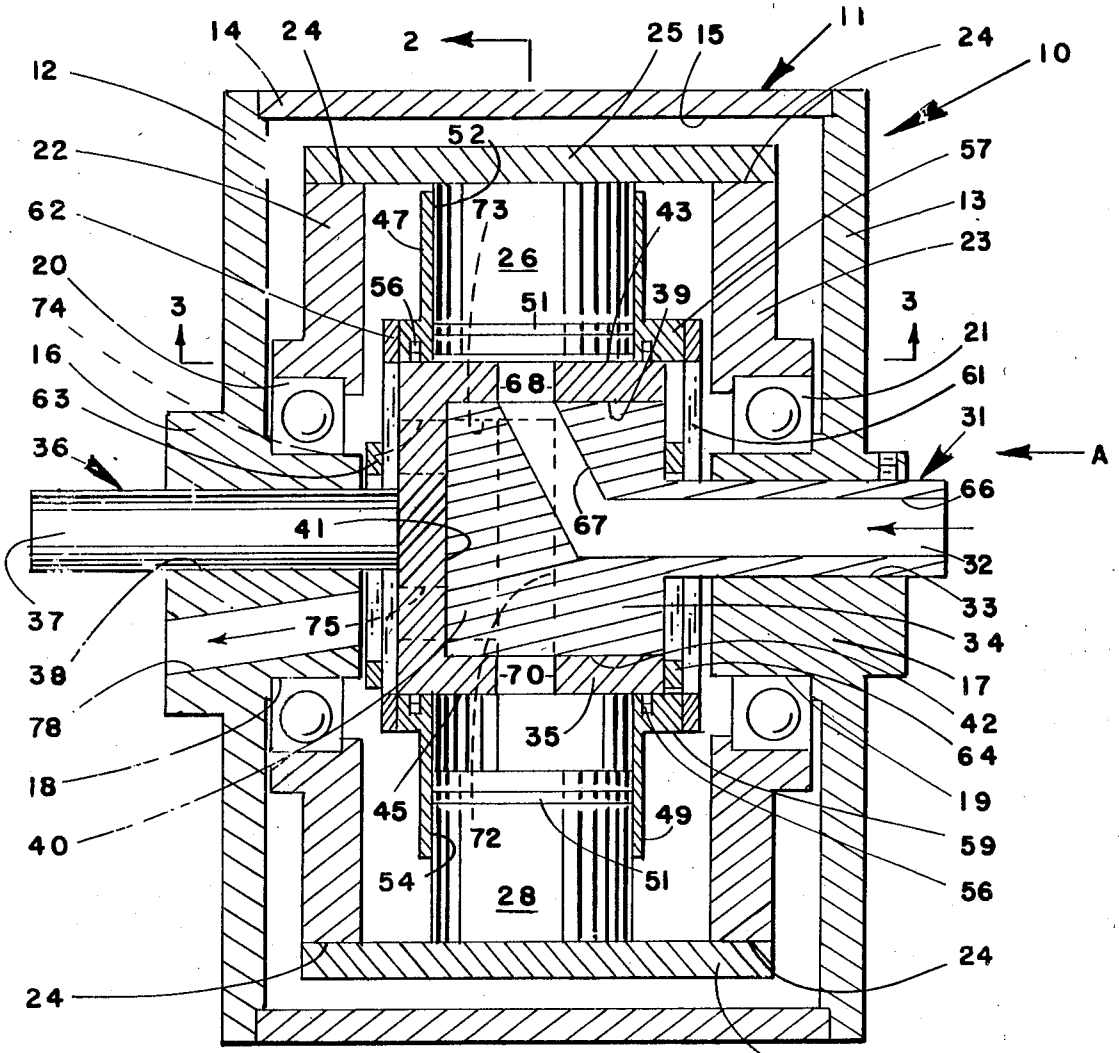
FIG. 1 is a longitudinal cross sectional view of this invention with certain parts shown in elevation.

Referring now to the drawings, the engine 10 has a stationary three (3) piece housing 11 made up, as seen in FIG. 1, of a left 12 and a right 13 annular end plate, respectively, secured to an intermediate annular member 14 having a cylindrical bore 15; the end plates 12 and 13 being conventionally suitably secured to the annular member 14 by a plurality of circumferentially spaced bolts (not shown). The end plates 12 and 13 have, respectively, an annular boss 16 and 17 formed thereon which bosses project both inwardly and outwardly of the respective end plate. The portion of the bosses 16 and 17 lying within the end plates 12 and 13 have formed thereon an annular shoulder 18 and 19, respectively, which shoulders 18 and 9 are formed concentrically with the cylindrical bore 15 in the housing 14 and have mounted thereon, respectively, a roller bearing assembly 20 and 21.

Figure 5:
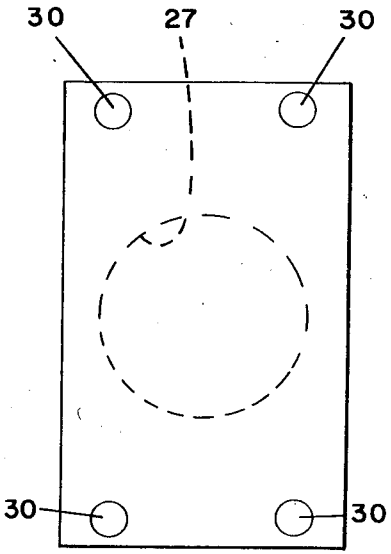
FIG. 5 is a view of the outer end of the right lateral piston of FIG. 2 when rotated ninety (90) degrees and viewed in the direction of the arrow B in FIG. 2.

Mounted on the outer race of the bearing assembly 20 is an annular piston supporting left side plate or member 22 and mounted on the outer race of the bearing assembly 21 is an annular piston supporting right side plate or member 23. As clearly seen in FIG. 2, the side plate 22 (as likewise the side plate 23) is provided with four (4) flat areas 24 which are spaced ninety (90) degrees from each other; the flat areas 24 on the side plate 22 being aligned with the flat areas on the side plate 23. Secured to the side plates 22 and 23 at the location of each of the flat areas 24 is the back plate 25 of one (1) of the four (4) pistons, 26, 27, 28 or 29; the back plates forming the sole connection between the side plates 22 and 23 which are secured thereto by a plurality of bolts 30, which bolts are seen in FIG. 5. It is thus seen that the side plates 22 and 23 form the outer rotatable member, and this member together with the pistons 26–29 rotates unitarily and such rotation is concentric with the bore 15 in the housing 14 and concentric with the shoulders 18 and 19.

A stationary shaft 31 is mounted in the boss 17 of the end plate 13 and has a shaft portion 32 received in a bore 33 of the boss 17. A bore 33 is disposed above the center line of the shoulder 19 of the boss 17 so that the shaft 31 and the bearing 21 are eccentric relative to one another. The shaft 31 projects from outside the right side of the end plate 13, leftwardly into the housing 11 where it terminates in an enlarged cylindrical end 34, which cylindrical end is disposed substantially medially between the end plates 12 and 13. The central axis of the cylindrical end 34 is coaxial with the shaft 31 and therefore eccentric relative to the cylindrical bore 15 of the housing 11.

Mounted for rotation on the cylindrical end 34 of the shaft 31 is the inner end 35 of an output shaft 36. For purposes of illustration, the shaft 36 shall be referred to as an output shaft; however, if the engine 10 was being operated as a pump, the output shaft 36 would be a driven input shaft.

The output shaft 36 is coaxial with the shaft 31 and therefore will rotate eccentrically relative to the bore 15 in the housing 11 and also eccentrically with respect to the shoulders 18 and 19 and the pistons 26–29.

The output shaft 36 has a cylindrical shaft portion 37 which is rotatably mounted in a bore 38 formed in the annular boss 16, which bore 38 is coaxial with the bore 33. The shaft 37 projects outwardly to the left of the end plate 12 where it is available for suitable coupling.

Figure 2:
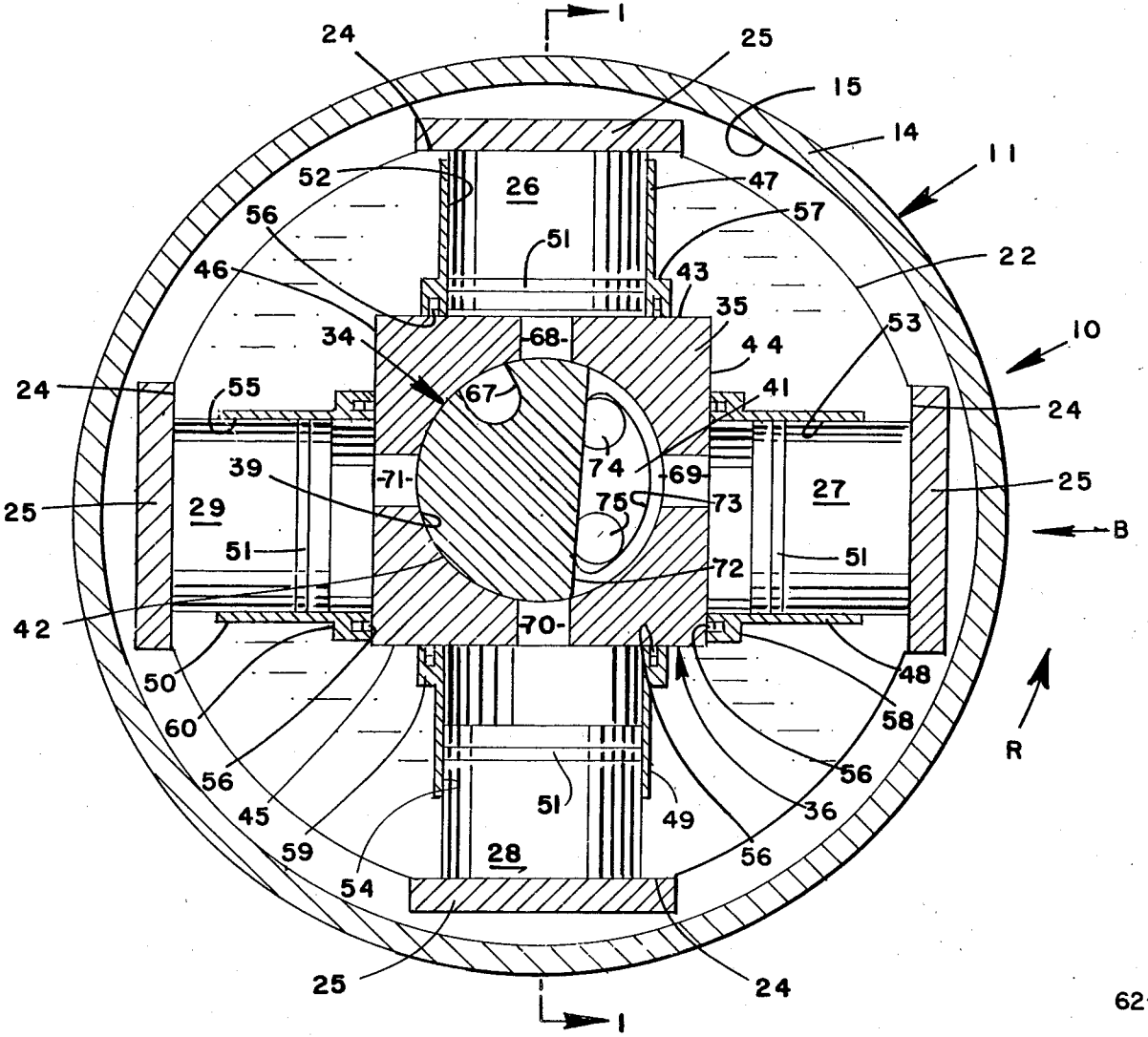
FIG. 2 is a cross sectional view taken substantially on the line 2—2 of FIG. 1.
Figure 6:
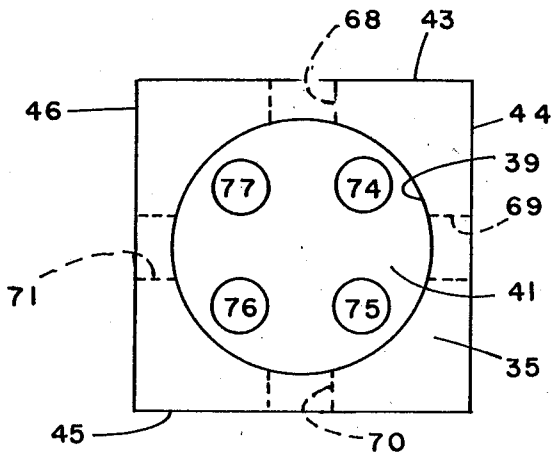
FIG. 6 is a view of the inner end of the output shaft when viewed in the direction of the arrow A in FIG. 1.

The outer surface of the inner end 35 of the output shaft 36 is substantially square when viewed in cross section in FIG. 1 and is square when viewed in cross section in FIG. 2. This inner end 35 will be occasionally referred to herein as a square cam, and said inner end has a cylindrical bore 39, the cylindrical shape being apparent when viewed in FIGS. 2 and 6. The cylindrical bore 39 rotatably receives the cylindrical inner end 34 of the stationary shaft 31. As seen in FIG. 1, the left end 40 of the cylindrical inner end 34 slideably and rotatably abuts the inner wall 41 at the left side of the inner end 35 of the output shaft 36, while the cylindrical periphery 42 closely fits and is rotatably received in the cylindrical bore 39 in the output shaft 36.

As seen in FIG. 2, the inner end 35 of the output shaft 36 is formed as a square cam and has four flat surfaces, an upper flat surface 43 facing piston 26, a right flat surface 44 facing piston 47, a lower flat surface 45 facing piston 28 and a left flat surface 46 facing piston 29 are provided. Since the square cam 35 rotates with the output shaft 36, these designations of upper, lower, left and right with respect to the flat surfaces 43–46 is for convenience only and is only applicable when the position of FIG. 2 is present. Rotation from this position obviously will change the position of the flat surfaces 43–46 and also of the pistons 26–29. However, the pistons 26–29 will always remain perpendicular to the adjoining flat surface of the square cam 35.

Slidingly and sealingly disposed on the flat surface 43 is an upper cylinder 47, on the surface 44 is a right cylinder 48, on the surface 45 is a lower cylinder 49 and on the surface 46 is a left cylinder 50. The cylinder 47 slidingly and sealingly receives the piston 26 for relative telescoping piston-cylinder type movement while the cylinder 48 receives a piston 27, the cylinder 49 receives a piston 28 and the cylinder 50 receives a piston 29 for relative telescopic movement. A separate piston ring 51 is disposed in each of the pistons 26–29 to sealingly engage the bores 52–55, respectively, of the cylinders 47–50, respectively.

Referring to FIGS. 1, 2, 3A and 3B, disposed in a groove in the bottom surface of each of the cylinders is a sealing ring 56 which sealing ring sealingly engages the adjacent flat surface 43–46 of the square cam 35.

The cylinders 47–50 have an enlarged base 57–60, respectively, which base as seen in FIG. 2, is smaller than the flats 43–46 of the square cam in the transverse direction, but as seen in FIG. 1, with respect to the cylinders 47 and 49 (the same holding true for the cylinders 48 and 50), the bases 57 and 59 of the cylinders 47 and 49 are axially wider than the cam flats 43 and 45 (the bases 58 and 60 of the cylinders 48 and 50 being axially wider than the cam flats 44 and 46).

Figure 4:
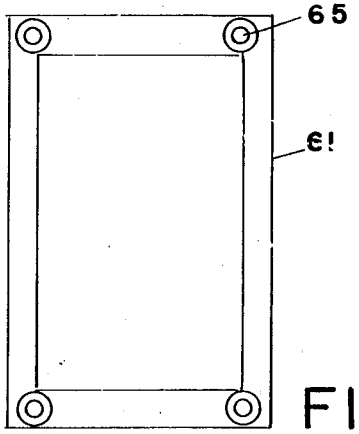
FIG. 4 is a side view of the right outer bridle ring of FIG. 1 when viewed in the direction of the arrow A in FIG. 1.

As seen in FIG. 1, the bases 57 and 59 axially overlie the right end of the square cam 36 and such bases are joined by an outer bridle ring 61 which ring is suitably secured to the extending base as by a pair of spaced bolts 65, not seen in FIG. 1, but illustrated in FIG. 4 on the bridle ring 61. There are four (4) bridle rings in total, and all appear identical in size and shape to the ring 61; it is merely the location and the parts which are secured thereby which differ. The left side of the bases 57 and 59 are joined by an inner bridle ring 62. The reason for calling the latter an "inner" bridle ring 62 is that the "outer" bridle ring 63 which connects the left side of the bases 58 and 60 of the cylinders 48 and 50, lies axially outwardly of the inner bridle ring 62. The reason for calling the bridle ring 61 an "outer" bridle ring is that it lies axially outwardly of the inner bridle ring 64 which joins the bases 58 and 60 of the cylinders 48 and 50, respectively.

Figure 3B:
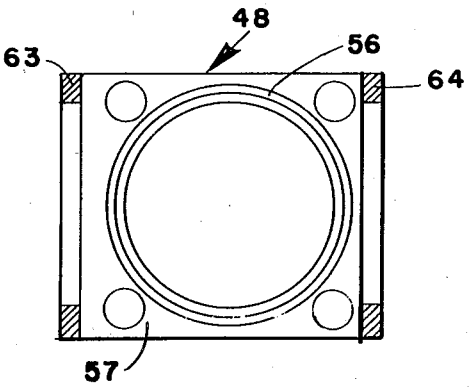
FIG. 3B is a view similar to FIG. 3A, but of one of the laterally disposed cylinders (the right cylinder as seen in FIG. 2), which lateral cylinders cannot be seen in FIG. 1 but can be seen in FIG. 2.
Figure 3A:
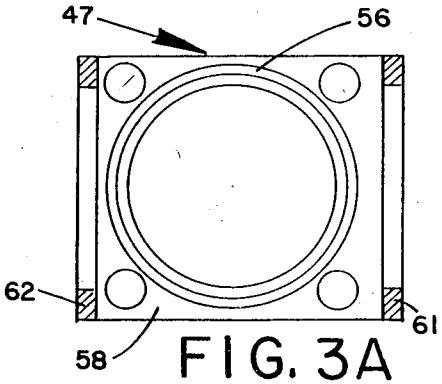
FIG. 3A is a view of the bottom of the upper cylinder of FIG. 1 when viewed along the lines 3—3 in FIG. 1.

As shown in FIG. 3A, the base 57 of the piston 47 is enlarged to the right so that it would axially overlie the square cam 36 to the right, as seen in FIG. 1, while in FIG. 3B the base 58 of the piston 48 is enlarged to the left and would overlie the square cam axially to the left if such could be seen in FIG. 1.

The purpose for interleaving the bridle rings 61–64 instead of having two (2) outer bridle rings on two (2) opposed pistons and two (2) inner bridle rings on the other two (2) opposed pistons as is common in the prior art, is to balance the rotating portion of the engine, that is, each pair of pistons has an outer and each pair has an inner bridle ring, and the bases of all four (4) pistons are the same size.

The purpose of the bridle rings is to hold the cylinders they connect against the adjoining flat face of the square cam 36 and also to insure that the cylinders reciprocate unitarily.

Since the cylinders 47–50 continuously engage the square cam 36, they are always disposed perpendicularly relative thereto while moving translatory relative to the square cam. As seen in FIG. 2, when the upper cylinder 47 moves clockwise to the position of cylinder 50, it moves downwardly on the square cam. When the cylinder 47 reaches the position of the cylinder 49 it will again be centralized on the flat surface, while when it reaches the position of the cylinder 48 it will again move downwardly on the square cam. When it returns to its original upper position, the cylinder 47 will again be centralized. The bridle rings 61–64 allow such movement of the cylinders 48–50 while holding the same against their respective flat surfaces 43–46.

As shown in FIGS. 3A and 3B, in the bottom of the base 57 or 58 (and likewise in the bottom of the bases 59 and 60, not shown), four (4) Teflon buttons are disposed in the bottom of the bases and are positioned to slidingly engage the flat surface 43–46 against which the base 57–60 respectively engage. The buttons are disposed peripherally of the seal 56 in the base and are for the purpose of reducing friction between the cylinder and the flat surface and also to reduce wear and load on the seals 56.

Fluid pressure passages are provided in the stationary shaft 31 and in the output shaft 36. More particularly, the shaft portion 32 of the stationary shaft 31 has a central aperture 66 extending inwardly from the outer end of the shaft 31; the aperture 66 being available for conventional connection to a supply of fluid pressure. The supply and the control system therefor are not shown in the drawings and can be one of many types of conventional pressure fluid supplies, as for an air motor.

The aperture 66 extends inwardly of the shaft portion 32 and then an upward angling aperture portion 67, formed in the cylindrical end 34, extends from the aperture 66 to open out of the cylindrical periphery 42 of the end 34 slightly counterclockwise of top dead center as viewed in the operative position of FIG. 2. The square cam 36 has four (4) radially extending openings in the inner end 35 thereof, an opening 68 in the cam flat 43, an opening 69 in flat 44, an opening 70 in flat 45, and an opening 71 in flat 46.

The openings 68–71 are positioned so as to lie in the same plane of the outer end of the aperture 67 and are adapted to be alternately brought into a confluent relationship with the aperture 67 upon relative rotation of the stationary shaft and the square cam. When a particular opening 68–71 is confluent with the aperture 67, pressure fluid will be introduced to the cylinder which is in engagement with the cam flat in which the particular opening 68–71 is located. This pressure fluid acts between the inner end of the associated piston 26–29 and the cam flats 43–46, respectively, and the reaction load between the piston and the cam flat causes rotation of the square cam 36 accompanied by reciprocal movement of the cylinders 47–50 relative to the non-reciprocating pistons 26–29. Since the pistons are within the cylinders, the pistons and the end plates 22 and 23 will be carried to rotate unitarily with the square cam, while the square cam moves eccentrically relative to the pistons and the pistons 26–29 remaining perpendicular to its associated cam face 43–46 and coaxial with the cylinder 47–50, respectively, receiving the piston 26–29.

The stationary shaft is provided with an exhaust slot 72 formed therein coplanar with the opening of aperture 67 and coplanar with the openings 68–71. The slot 72 is chordally disposed and is, as seen in FIG. 2, disposed clockwise of top dead center with respect to the aperture 67. An axially forwardly extending half moon shaped opening 73 extends forwardly from the exhaust slot 72 and opens from the left end (left as seen in FIG. 1) 40 of the cylindrical end 34 of the stationary shaft 31.

Four equally spaced (4) exhaust ports, (two being seen in FIGS. 1 and 2 and all four being shown in FIG. 6) 74, 75, 76 and 77 are formed in the inner wall of the cylindrical bore of the square cam, and, upon becoming confluent with the half moon shaped opening 73, are capable of venting a particular opening(s) 68, 69, 70 and 71, which, at that particular time, is confluent with the exhaust slot 72. The venting of the opening 68, 69, 70 and 71 vents the particular cylinder 47–50 which is confluent with the particular opening 68–71.

A final exhaust port 78 is formed in the annular boss 16 and extends from inside the housing 11 to the outside thereof so that fluid pressure from the exhaust ports 74–77 may be exhausted from the housing.

It will thus be seen that the objects set forth above, and those made apparent from the foregoing description, are efficiently attained and since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described,

What is claimed is:

1. A rotary engine comprising, in combination, a non-rotatable housing having a central axis, a first member rotatably mounted in said housing for rotation about said central axis and having its axis of rotation coaxial with the axis of said housing, a first and a second pair of pistons with the pistons of each pair of pistons being diametrically opposed to and coaxial with each other, said pairs of pistons being rigidly secured to said first member adjacent the external periphery thereof and projecting radially inwardly therefrom, a power shaft rotatably mounted in said housing and having a shaft portion thereof extending from said housing and a square cam portion thereof disposed within said housing centrally of and spaced from said pistons, said shaft being eccentrically mounted with respect to said housing and said first member, said square cam having four flat surfaces thereon with each of said surfaces having one of said pistons disposed perpendicularly relative thereto and, as a result of said eccentric mounting of said shaft, said shaft rotating eccentrically relative to said pistons and said first member, a cylinder sealingly and telescopically received on each of said pistons with the radially inner end of each cylinder sealingly and slideably engaging a different one of said flat surfaces of said square cam and being disposed constantly perpendicular to such engaged flat surface, said cylinders being disposed in two pairs with the cylinders of each pair being opposed and coaxial, two pairs of bridle rings, with each pair of bridle rings connecting one opposed pair of cylinders and said bridle rings insuring that opposed cylinders move conjointly and that their inner ends sealingly engage said square cam, fluid passageways being formed in said square cam to exhaust and charge said cylinders, a stationary shaft mounted in said housing coaxially with said power shaft, said stationary shaft rotatably mounting the inner end of said power shaft, inlet and outlet fluid passageways being formed in said stationary shaft and being positioned confluently with the fluid passageways formed in said square cam, said cylinders and the piston received therein remaining constantly coaxial to each other and perpendicular to the cam flat they are associated with, each of said cylinders having a sealing means disposed between the inner end of said cylinder and said cam flat and said inner end of said cylinder includes friction reducing means disposed outwardly of said sealing member to reduce friction between said cylinder and said cam surface and to prevent excess load on said sealing member, wherein relative rotation between said stationary shaft and said power shaft opens and closes said passageways, and whereby the fluid from said passageways reacts between said cam flats and the inner ends of said pistons.

2. A device according to claim 1, wherein said cylinders have base portions engaging said flats, the base portion of one pair of said cylinders is axially elongated in the first axial direction greater than said second pair of cylinders is elongated in said first direction and said second pair of cylinders is axially elongated in said opposite axial direction greater than said first pair of cylinders, said bridle rings are secured to the axial ends of the base portions of said cylinders, whereby the bridle rings joining one pair of cylinders are interleaved with the bridle rings joining the second pair of cylinders.

* * * * *